US008826627B2

(12) United States Patent
Hongo et al.

(10) Patent No.: US 8,826,627 B2
(45) Date of Patent: Sep. 9, 2014

(54) JOINT METHOD FOR REINFORCING BAR

(71) Applicant: Splice Sleeve Japan, Ltd., Tokyo (JP)

(72) Inventors: Kouju Hongo, Inzai (JP); Masaaki Ase, Tsukuba (JP); Jutaro Nagaishi, Tokyo (JP); Hironori Hamada, Sakura (JP)

(73) Assignee: Splice Sleeve Japan, Ltd., Tokyo (JP)

( * ) Notice: Subject to any disclaimer, the term of this patent is extended or adjusted under 35 U.S.C. 154(b) by 0 days.

(21) Appl. No.: 13/718,109

(22) Filed: Dec. 18, 2012

(65) Prior Publication Data

US 2014/0060721 A1 Mar. 6, 2014

(30) Foreign Application Priority Data

Sep. 6, 2012 (JP) ..... 2012-195739

(51) Int. Cl.
*E04C 5/16* (2006.01)
*E04C 5/00* (2006.01)

(52) U.S. Cl.
CPC ..... *E04C 5/00* (2013.01)
USPC ..... 52/742.16; 405/266

(58) Field of Classification Search
USPC ..... 52/742.1, 742.11, 742.12, 742.13, 52/742.14, 742.15, 742.16, 745.01, 52/745.02, 745.03, 745.04, 745.05, 52/745.06, 745.07, 745.08, 745.09, 745.1, 52/745.12, 745.13, 745.14, 745.15, 52/745.16, 745.17, 745.18, 745.19, 745.2, 52/745.21, 424, 425, 426, 427, 428, 429, 52/430, 431; 405/266, 267, 268, 269, 405/259.5, 251, 252; 403/305
See application file for complete search history.

(56) References Cited

U.S. PATENT DOCUMENTS

| | | | | |
|---|---|---|---|---|
| 4,069,677 A * | 1/1978 | Yamada et al. | ..... | 405/259.5 |
| 4,386,876 A * | 6/1983 | Dupeuble | ..... | 405/259.5 |
| 6,189,281 B1 * | 2/2001 | Sobek | ..... | 52/514.5 |

FOREIGN PATENT DOCUMENTS

| | | |
|---|---|---|
| JP | 05-061422 | 9/1993 |
| JP | 09-209506 | 8/1997 |

* cited by examiner

*Primary Examiner* — William Gilbert
*Assistant Examiner* — Kyle Walraed-Sullivan
(74) *Attorney, Agent, or Firm* — Flynn, Thiel, Boutell & Tanis, P.C.

(57) ABSTRACT

In a joint method for a reinforcing bar using a reinforcement joint having a grout inlet at one end and a grout outlet at the other end, the grout inlet is fitted with a sealing body provided with a check valve, and the grout outlet is fitted with a sealing plug provided with a piston body which is moved outward when the reinforcement joint is filled with grout, whereby the filling of the reinforcement joint can be visually confirmed.

27 Claims, 10 Drawing Sheets

JOINT METHOD FOR REINFORCING BAR

BACKGROUND OF THE INVENTION

1. Field of the Invention

The present invention relates to a joint method for a reinforcing bar using a grout-filled reinforcement joint constituted of a strong elongated tubular body.

2. Related Background Art

A grout-filled reinforcement joint (hereinafter referred to as a reinforcement joint) is buried in reinforced concrete and is used for joining various reinforcing bars such as deformed reinforcing bars (hereinafter referred to as reinforcing bars) including round steel reinforcing bars or screw node reinforcing bars in the reinforced concrete.

A reinforcement joint is disclosed in Japanese Patent Application Publication No. 5-61422 and so on. The reinforcement joint is constituted of a strong elongated cylindrical body opened at both ends. Reinforcing bars as a pair are inserted into the cylindrical body from opposite directions, and then a grout (which is a filling material including mortar, epoxy resin, and so on and has high strength) is injected and filled. The reinforcing bars are fixed in the cylindrical body by hardening of the grout, and thus the reinforcing bars as a pair are joined.

When the reinforcement joint is employed, an end of a reinforcing bar is not required to be processed, and a precision cut is not required. In addition, eccentricity and inclination of the reinforcing bar at the joining portion are within a tolerable range, and the reinforcement joint has such an excellent feature that residual elongation and shrinkage do not occur at the joining portion.

In the above reinforcement joint, in the injection of a grout into a conventional reinforcement joint, there has been employed a process of fitting a tubular body such as a vinyl tube into the inlet, connecting a cylinder head of a discharge pipe of a pump for injection, and injecting and filling the grout. In this process, after the injection, the tubular body or the cylinder head of the discharge pipe is removed from the inlet, and a rubber stopper is required to be fitted into the inlet. Thus, there is a problem that a large amount of the grout once filled leaks outside while the tubular body or the cylinder head of the discharge pipe is removed from the inlet.

In order to prevent the leakage of the grout, after the injection is terminated, a front end of the cylinder head of the discharge pipe of the pump for injection is folded and then tied with a wire, and the grout starts to be hardened. The grout is left as it is until the flowability of the grout is lost, and then the operation of removing the tubular body is required to be performed. However, since several hours or half a day is required before the next operation, in order to increase efficiency, the operation of a pump for injection is not interrupted, the front end of the cylinder head of the discharge pipe is cut and bent for each single injection to stop the leakage of the grout, and the injection operation in the next portion is advanced. However, in this method, the injection operation is complicated, and there is a problem that cost is increased.

An opening of a communicating tube or a continuous hole is previously fitted with a rubber stopper on the grout outlet side of the reinforcement joint to prevent the leakage of the grout being filled, and when the flowability of the grout is lost after the filling of the grout, the operation of removing the rubber stopper is performed. The grout initially flowing from the opening is a muddy liquid rich in paste components, and this is because the grout being injected is slightly separated, and light paste components are easily assembled to the injection front end. Excess water is discharged due to the leakage of the muddy liquid, so that the grout becomes a strong filling material, and therefore, the injection is required to be continued until the muddy liquid is discharged outside.

However, since the opening of the communicating tube or the continuous hole is on the same plane as an outer wall surface of the reinforcement joint, the muddy liquid drips down along the outer wall surface, and there is such a drawback that the muddy liquid contaminates the outer wall surface. Thus, although a cleaning operation referred to as deburring is required to be performed after the injection, this operation requires time and expense, and this is a source of concern to workers. After a hardened material of the muddy liquid deposited onto the outer wall surface is removed by deburring, there is a problem that a discolored area infiltrated with the muddy liquid remains and deteriorates the appearance of the outer wall surface. Furthermore, in the case of at-once injection, it takes time to confirm whether the grout is simultaneously filled in a large number of reinforcement joints.

SUMMARY OF THE INVENTION

In order to solve the above problems, the present invention provides a joint method for a reinforcing bar according to a reinforcement joint, which prevents a grout from flowing from an inlet of a reinforcement joint and, at the same time, allows continuous injection operation without cutting a cylinder head of a discharge pipe used for injection of the grout. Further, the invention can prevent a muddy liquid from flowing outside on the outlet side and, at the same time, can easily confirm filling of the grout in the reinforcement joint, and furthermore can automatically close the outlet after the filling and after the flowing out of the muddy liquid.

According to the present invention, there is provided a joint method for a reinforcing bar including the steps of:

providing a strong elongated reinforcement joint which is surrounded by a side wall, is a cylindrical body having openings at both the left and right ends, and includes a grout inlet provided at one end of the side wall and an outlet provided at the other end;

when the grout inlet is a protruding opening protruding outward, fitting the protruding opening with a cylindrical sealing body constituted of an elastic body including a check valve provided at one end;

when the grout outlet is a protruding opening protruding outward, fitting a sealing plug in the protruding opening directly or through an extending pipe, the sealing plug including a plug body constituted of an elastic body having a through hole at the center, a shaft body movably and loosely inserted into the through hole, and a piston body including a pressure receiver provided at a position protruding from the plug body of the shaft body and located inside and a retaining end provided at the position protruding from the plug body of the shaft body and located outside;

loosely inserting the reinforcing bars into an inside space of the cylindrical body from both the left and right ends at a position which is a connecting portion between the reinforcing bars in a member, a structure, or the like until the reinforcing bars reach an abutment position or a proximal position;

forcibly pressing the shaft body in the through hole of the sealing plug from outside to inside and positioning so that the pressure receiver at a front end of the shaft body protrudes to the cylindrical body side and the inside space of the cylindrical body and the through hole communicate with each other;

mounting a grout insertion end of a tube body connected to a grout supply means to a sealing body fitted in the grout inlet and injecting a grout into the inside space of the cylindrical body or into a gap between the inside space and a member or a structure communicating with the inside space by pump pressure;

previously flowing paste components of the grout in the through hole through a communicating portion between the pressure receiver protruding toward the cylindrical body of the sealing plug fitted in the grout outlet and the inside space of the cylindrical body and filling the inside of the through hole; and stopping the injection of the grout once the pressure receiver is pushed outward by pressure of the grout continuously filled in the inside space of the cylindrical body and the retaining end of the shaft body protrudingly moves outward to a predetermined position.

According to the present invention, there is provided a joint method for a reinforcing bar including the steps of:

providing a strong elongated reinforcement joint which is surrounded by a side wall, is a cylindrical body having openings at both the left and right ends, and includes a grout inlet provided at one end of the side wall and an outlet provided at the other end;

providing a sealing member with a reinforcing bar insertion hole at one or both openings at both the left and right ends of the cylindrical body and blocking a gap generated between the inserted reinforcing bar and an edge portion of the opening;

when the grout inlet is a protruding opening protruding outward, fitting a cylindrical sealing body constituted of an elastic body including a check valve provided at one end of the protruding opening;

when the grout outlet is a protruding opening protruding outward, fitting a sealing plug in the protruding opening directly or through an extending pipe, the sealing plug including a plug body constituted of an elastic body having a through hole at the center, a shaft body movably loosely inserted into the through hole, and a piston body including a pressure receiver provided at a position protruding from the plug body of the shaft body and located inside and a retaining end provided at the position protruding from the plug body of the shaft body and located outside;

loosely inserting the reinforcing bars into an inside space of the cylindrical body from both the left and right ends at a position which is a connecting portion between the reinforcing bars in a member, a structure, or the like until the reinforcing bars reach an abutment position or a proximal position;

forcibly pressing the shaft body in the through hole of the sealing plug from outside to inside and positioning so that the pressure receiver at a front end of the shaft body protrudes to the cylindrical body side and the inside space of the cylindrical body and the through hole communicate with each other;

mounting a grout insertion end of a tube body connected to a grout supply means to a sealing body fitted in the grout inlet and injecting a grout into the inside space of the cylindrical body or into a gap between the inside space and a member or a structure communicating with the inside space by pump pressure;

previously flowing paste components of the grout in the through hole through a communicating portion between the pressure receiver protruding toward the cylindrical body of the sealing plug fitted in the grout outlet and the inside space of the cylindrical body and filling the inside of the through hole; and stopping the injection of the grout once the pressure receiver is pushed outward by pressure of the grout continuously filled in the inside space of the cylindrical body and the retaining end of the shaft body protrudingly moves outward to a predetermined position.

According to the present invention, there is provided a joint method for a reinforcing bar including the steps of:

providing a strong elongated reinforcement joint which is surrounded by a side wall, is a cylindrical body having openings at both the left and right ends, and includes a grout inlet provided at one end of the side wall and an outlet provided at the other end;

when the grout inlet is a protruding opening protruding outward, fitting the protruding opening with a cylindrical sealing body constituted of an elastic body including a check valve provided at one end;

when the grout outlet is a protruding opening protruding outward, fitting a sealing plug in the protruding opening directly or through an extending pipe, the sealing plug including a plug body constituted of an elastic body having a through hole at the center, a shaft body movably loosely inserted into the through hole, and a piston body including a pressure receiver provided at a position protruding from the plug body of the shaft body and located inside and a retaining end provided at the position protruding from the plug body of the shaft body and located outside;

providing a sealing member with a reinforcing bar insertion hole at one or both openings at both the left and right ends of the cylindrical body and blocking a gap generated between the inserted reinforcing bar and an edge portion of the opening;

loosely inserting the reinforcing bars into an inside space of the cylindrical body from both the left and right ends at a position which is a connecting portion between the reinforcing bars in a member, a structure, or the like until the reinforcing bars reach an abutment position or a proximal position;

forcibly pressing the shaft body in the through hole of the sealing plug from outside to inside and positioning so that the pressure receiver at a front end of the shaft body protrudes to the cylindrical body side and the inside space of the cylindrical body and the through hole communicate with each other;

mounting a grout insertion end of a tube body connected to a grout supply means to a sealing body fitted in the grout inlet and injecting a grout into the inside space of the cylindrical body or into a gap between the inside space and a member or a structure communicating with the inside space by pump pressure;

previously flowing paste components of the grout in the through hole through a communicating portion between the pressure receiver protruding toward the cylindrical body of the sealing plug fitted in the grout outlet and the inside space of the cylindrical body and filling the inside of the through hole; and stopping the injection of the grout once the pressure receiver is pushed outward by pressure of the grout continuously filled in the inside space of the cylindrical body and the retaining end of the shaft body protrudingly moves outward to a predetermined position.

According to the joint method for a reinforcing bar, in a final step of stopping the injection of the grout once the pressure receiver protruding toward the cylindrical body of the plug body fitted in the protruding opening of the grout outlet directly or through the extension pipe is pushed outward by the pressure of the grout filled in the inside space of the cylindrical body and the retaining end side of the shaft body protrudingly moves outward to the predetermined position, the grout enters into a plurality of reinforcement joints at other positions through a gap generated between members or structures at a position which is the connecting portion between the reinforcing bars in the member, the structure, or the like, and the injection of the grout is stopped once the retaining end sides of all the shaft bodies of the plurality of reinforcement joints protrudingly move outward to the predetermined position.

According to the joint method for a reinforcing bar, the sealing body is a long member extending in a longitudinal direction.

According to the joint method for a reinforcing bar, the check valve of the sealing body is provided on the inside space side of the cylindrical body.

According to the joint method for a reinforcing bar, the check valve of the sealing body is provided on the side of the cylindrical body as the grout supply means.

According to the joint method for a reinforcing bar, the pressure receiver of the plug body is provided removably from the shaft body.

According to the joint method for a reinforcing bar, the plug body of the sealing plug is formed so that a tapered surface is formed on a side surface in which an insertion side as a protruding opening side of an outlet is a small-diameter end surface and the other end side is a large-diameter end surface.

According to the joint method for a reinforcing bar, the grout insertion end of the tube body is a nozzle.

According to the joint method for a reinforcing bar, the grout insertion end of the tube body is mounted to an outer end of the sealing body.

Since an inlet of a reinforcement joint is fitted with a removable sealing body with a check valve for injection of a grout, a back flow of the grout can be prevented, and the grout does not flow outside. Further, it is necessary only to separate a nozzle and a tube body from the sealing body after the injection of the grout, and the nozzle and the tube body can be continuously used in the injection operation of another reinforcement joint. Furthermore, the grout can be simultaneously injected to a plurality of reinforcement joints at other positions through gaps generated between members and between structures, and the grout can be effectively filled in many reinforcement joints.

Since an outlet of the reinforcement joint is directly or indirectly fitted with a removable sealing plug which, when the grout is filled, closes the outlet automatically after the paste components are discharged, an invisible filling state of the grout inside the reinforcement joint can be confirmed from outside, and, at the same time, the grout can be prevented from flowing outside through the outlet.

Furthermore, since the sealing body and the sealing plug can be easily fitted in construction sites when the reinforcement joint is installed, the sealing body and the sealing plug are not damaged in operation before the installment of the reinforcement joint, such as during transportation of the reinforcement joint, and a construction operation for grout injection purposes can be reliably performed.

After solidification of the grout, both the sealing body and the sealing plug can be easily removed from the reinforcement joint, and the grout adhered to or filled in the sealing body and the sealing plug is removed and cleaned after the removal of the sealing body and the sealing plug, whereby the sealing body and the sealing plug can be reutilized.

DETAILED DESCRIPTION OF PREFERRED EMBODIMENTS

Hereinafter, the best modes for carrying out the present invention will be described based on the examples with reference to the drawings.

Example 1

Figure 1:
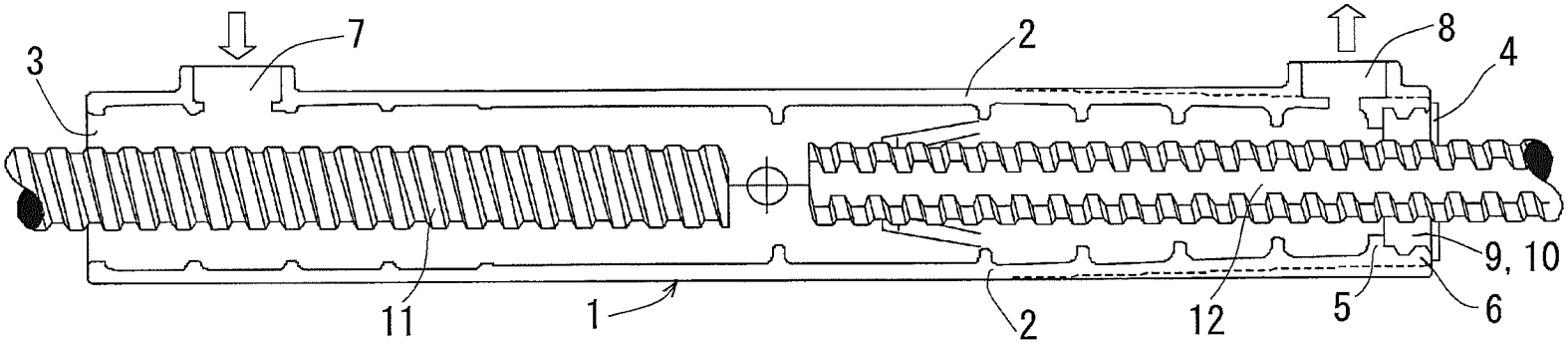
FIG. 1 is a cross-sectional view showing a state in which a reinforcing bar is inserted into a reinforcement joint used in a joint method for a reinforcing bar according to the present invention.

FIG. 1 shows a reinforcement joint 1 constituted of an elongated tubular body used in a joint method for a reinforcing bar according to the present invention. The reinforcement joint 1 has a side wall 2 constituting a cylindrical body manufactured using a strong material such as casting, cast iron, iron, and stainless and openings 3 and 4 at both ends. Brim portions 5 and 6 for preventing flowing out of a grout to be described below and retaining a sealing member are formed at both ends so as to protrude toward the opening side being inside the openings 3 and 4. In the example 1, the brim portions 5 and 6 are protrudingly formed as double brim portions.

The side wall 2 in proximity to the openings 3 and 4 is provided with a grout inlet 7, which is provided on one side and used for injecting a grout in an inside space of the reinforcement joint 1, and a grout outlet 8 which is provided on the other side and discharges an overflowing grout of the grout injected and filled in the inside space.

In order to prevent the grout injected into the inside space of the reinforcement joint 1 from flowing outside through a gap generated between edges of the openings 3 and 4 and a loosely inserted reinforcing bar, the openings 3 and 4 are provided with sealing members 9 and 10 accordingly to close the gap. In FIG. 1 of the example 1, the sealing member 10 is provided only on the opening 4 side. In some cases, the sealing members 9 and 10 are not provided, and there may be provided a means for actively flowing the grout outside through the gap, filling the gap between the reinforcement joint 1 and the structure, and filling the grout in the reinforcement joint 1 at another position.

Figure 2:
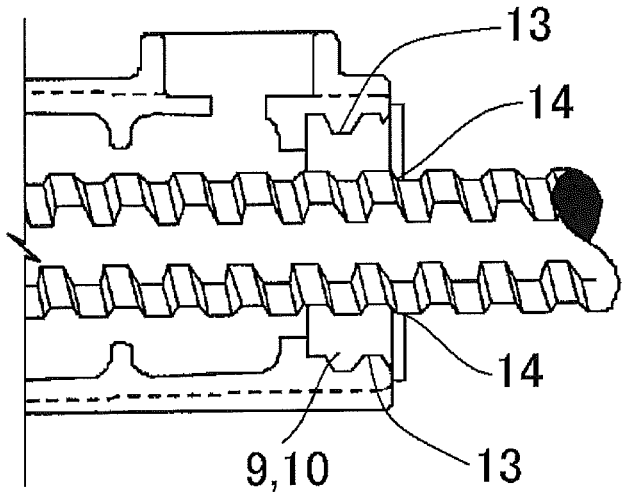
FIG. 2 is a cross-sectional view showing a relationship between an opening of the reinforcement joint and a sealing member.

A pair of reinforcing bars 11 and 12 are inserted in a loosely fitted state from the respective openings 3 and 4 which are the ends of the reinforcement joint 1 until the reinforcing bars 11 and 12 reach an abutment position or a proximal position. Since a gap is generated between the openings 3 and 4 and the reinforcing bars 11 and 12, a concavoconvex portion 13 anchored to or fitted in the brim portions 5 and 6 is provided if necessary at a peripheral portion having a bore diameter slightly larger than the diameters of the openings 3 and 4 as shown in FIG. 2, and the flexible sealing members 9 and 10 having an opening 14 through which the reinforcing bars 11 and 12 are inserted and molded of a synthetic resin material, a rubber material, or the like may be previously fixed at the center so as to be anchored to protrusions of the brim portions 5 and 6.

The sealing members 9 and 10 are previously mounted to the reinforcing bars 11 and 12 to be inserted, and the reinforcing bars 11 and 12 are stored at a predetermined position in the inside space of the reinforcement joint 1, whereby the gap between the openings 3 and 4 and the reinforcing bars 11 and 12 may be blocked.

FIG. 3 shows the grout inlet 7 side of the reinforcement joint 1, and the grout inlet 7 is provided with an opening on the side wall 2 and a protruding opening 15 constituted of a cylindrical body so as to protrude outward from the opening. The protruding opening 15 can be fitted with a cylindrical sealing body 16 constituted of an elastic body such as a synthetic resin material, a rubber material, or the like. The sealing body 16 has a bore diameter slightly larger than the bore diameter of the protruding opening 15, whereby the sealing body 16 can be fitted in the protruding opening 15 without falling off.

Figure 3A:
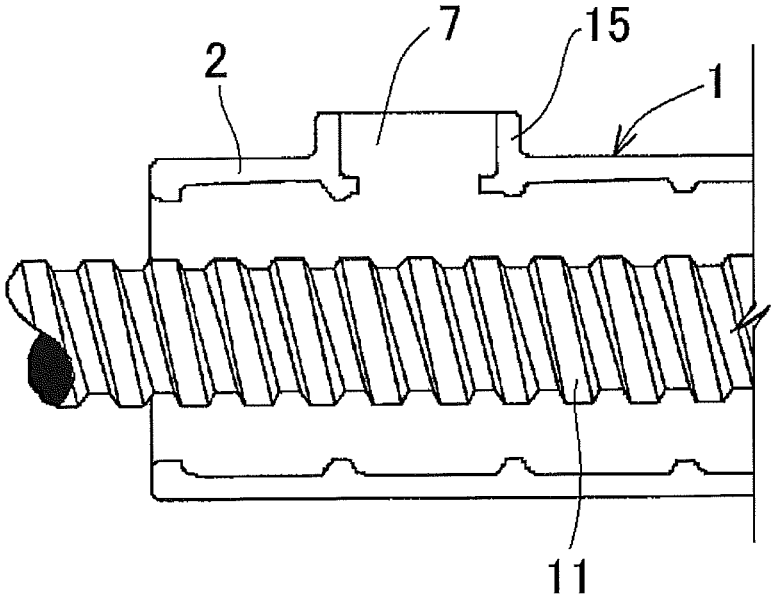
FIG. 3A is an enlarged cross-sectional view showing a grout inlet side of a reinforcement joint end.
Figure 3B:
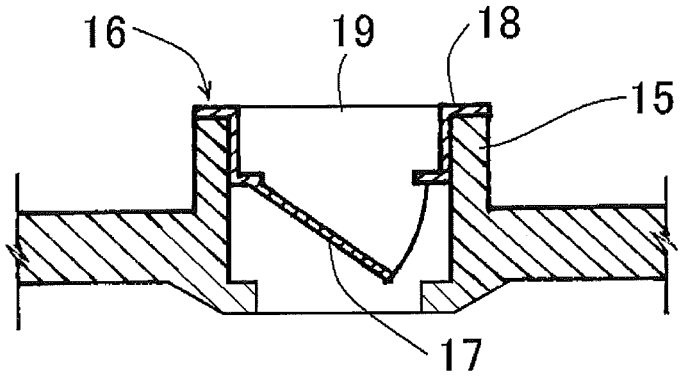
FIGS. 3B to 3D are cross-sectional views showing aspects of a sealing body.
Figure 3C:
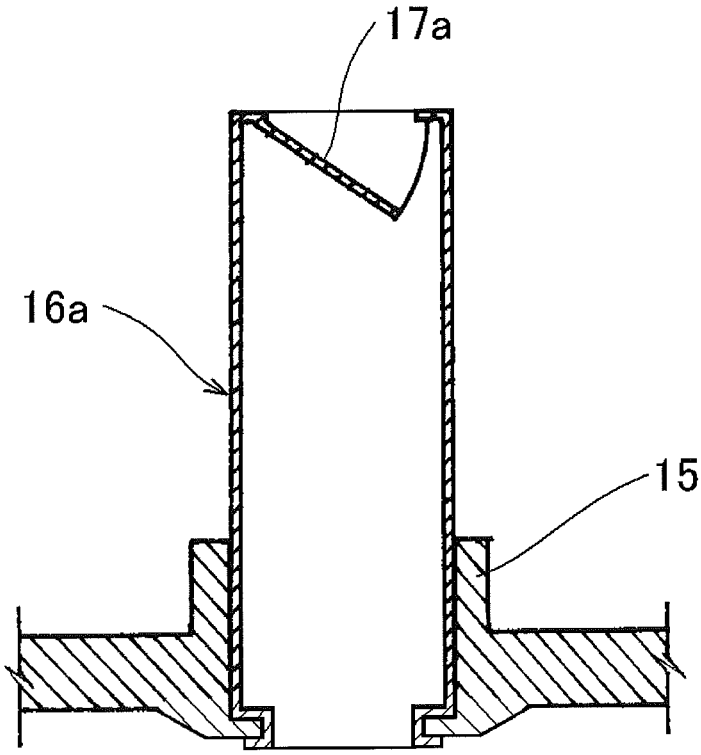
Figure 3D:
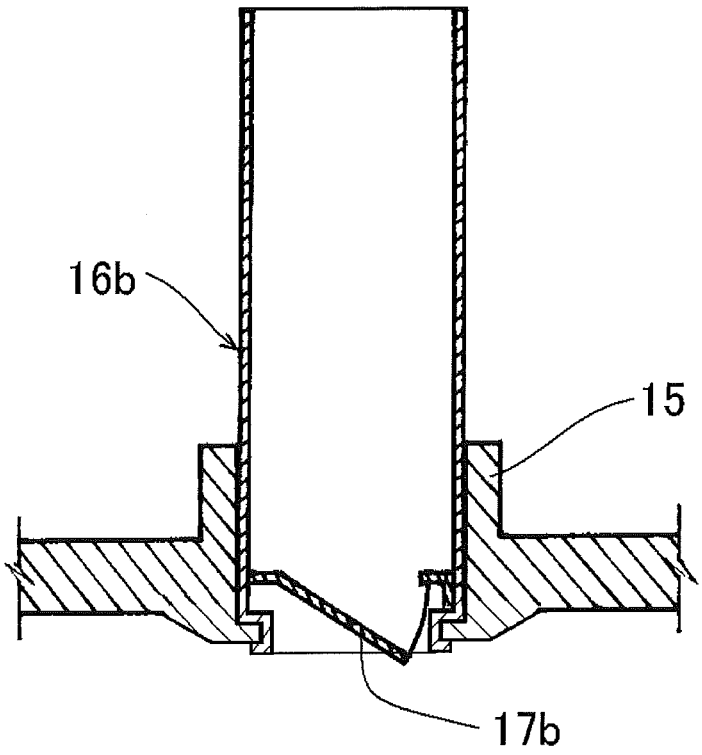

FIGS. 3B to 3D show some examples of the sealing body 16. FIG. 3B shows an aspect in which the sealing body 16 is directly fitted in an outer opening edge of the protruding opening 15. The sealing body 16 is a cylindrical body provided with an openable and closable check valve 17 on its bottom side, and the outer opening edge side is an opening 19 provided with a brim portion 18 protruding outward. The sealing body 16 is openable and closable in a direction opposite to the opening 19 side. When pressure is applied from the opening 19 side, the check valve 17 opens, and when the pressure is removed, the check valve 17 closes. The sealing body 16 of this example is a cylindrical body having a length smaller than the protruding length of the protruding opening 15, and thus, when the protruding opening 15 is fitted with the sealing body 16, the check valve 17 is located between the protruding length of the protruding opening 15. The sealing body 16 is fixed to the protruding opening 15 by an elastic body so as to be in a closely attached state, and when the grout is injected, pressure is applied from the opening side where there is the brim portion 18 toward the check valve 17; therefore, the brim portion 18 prevents the sealing body 16 from disconnecting from the protruding opening 15.

FIG. 3C shows an example of a sealing body 16*a* having a long cylindrical body, and a check valve 17*a* is provided on the outer front end side of the sealing body 16*a*. When the reinforcement joint 1 is installed at a deep position of a member, a structure, or the like, the sealing body is effective when the front end side which is a filling means is mounted. The outer side wall of the sealing body 16*a* is abutted against and closely attached to the inner side wall of the protruding opening 15 to allow resistance against inflow and outflow pressures of the grout. A protrusion is provided at a suitable position of the side wall and may be used as a retaining means. As the sealing body 16*a*, a rubber sealing body and a synthetic-resin sealing body formed of vinyl, polyethylene, or the like are effectively used.

FIG. 3D shows an example in which a check valve 17*b* is provided on an inner front end side of a sealing body 16*b* formed of rubber or synthetic resin, as described above. A cylindrical body which is a main body of the sealing body 16*b* is longer than the protruding length of the protruding opening 15. As in the example shown in FIG. 3C, the grout can be filled at a position separated from the reinforcement joint 1, and even if the reinforcement joint 1 is located on an inner back side of an assumed finished member such as a column or a beam, the filling construction can be performed.

An injection nozzle is attached to a cylinder head of a discharge pipe connected to a pump for injection, and a front end of the nozzle is forcibly pressed into the various sealing bodies 16, 16*a*, and 16*b*, whereby the check valves 17, 17*a*, and 17*b* open toward the inside space of the reinforcement joint 1. When the nozzle is pulled out after the injection, the check valves 17, 17*a*, and 17*b* move from the inside of the reinforcement joint 1 toward the outside of the reinforcement joint 1 and close the grout inlet 7. Consequently, the grout filled in the inside space of the reinforcement joint 1 can be prevented from flowing outside from the grout inlet 7.

Figure 3E:
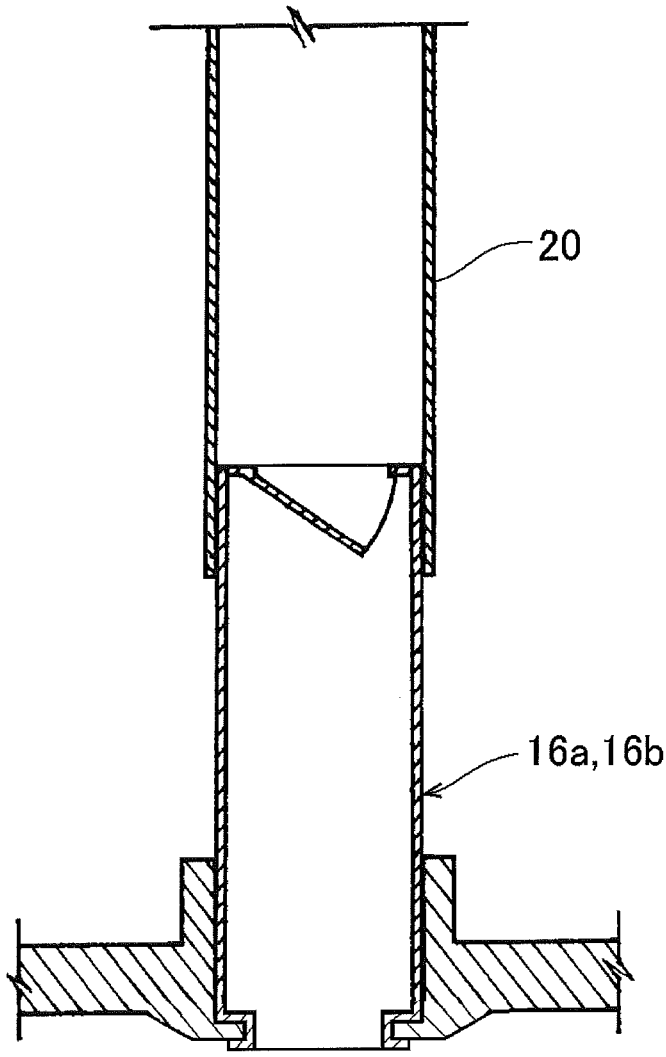
FIG. 3E is a cross-sectional view showing a fitting state between the sealing body and a tube body.

In a sealing body having a long cylindrical portion like the sealing bodies 16*a* and 16*b*, a nozzle is not attached to a cylinder head of a discharge pipe. As illustrated in FIG. 3E, a tube body 20 which is the cylinder head of the discharge pipe is directly fitted in the sealing bodies 16*a* and 16*b*, and the grout may be injected.

Figure 4A:
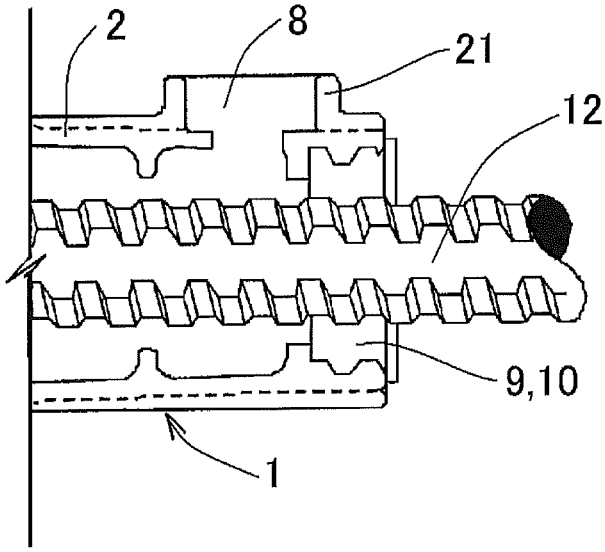
FIG. 4A is an enlarged cross-sectional view showing a grout outlet side of the reinforcement joint end.
Figure 4B:
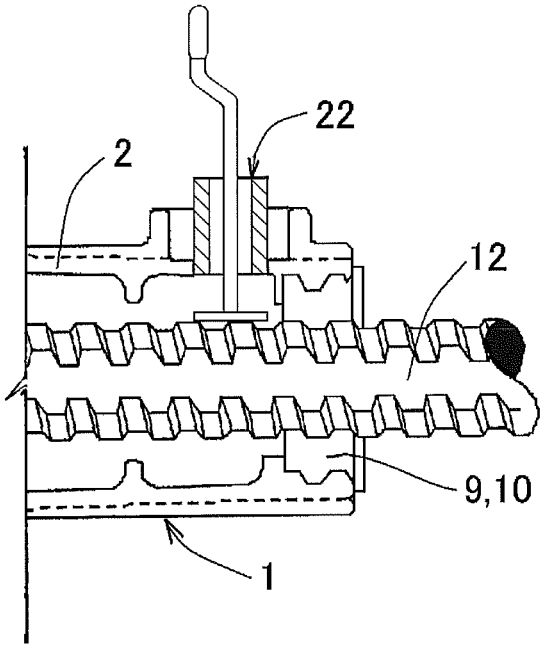
FIG. 4B is a cross-sectional view showing a state where the grout outlet is fitted with a sealing plug.

FIG. 4A is a cross-sectional view showing the grout outlet 8 side of the reinforcement joint 1. In FIG. 4A, the side wall 2 has an opening, and a protruding opening 21 constituted of a cylindrical body is provided so as to protrude outward from the opening. The grout injected from the grout inlet 7 fills the inside space of the reinforcement joint 1 from one end side in the inside space of the reinforcement joint 1 to the other end side through the center and reaches a position of a sealing plug 22 of FIG. 4B fitted in the protruding opening 21 of the grout outlet 8.

Figure 4C:
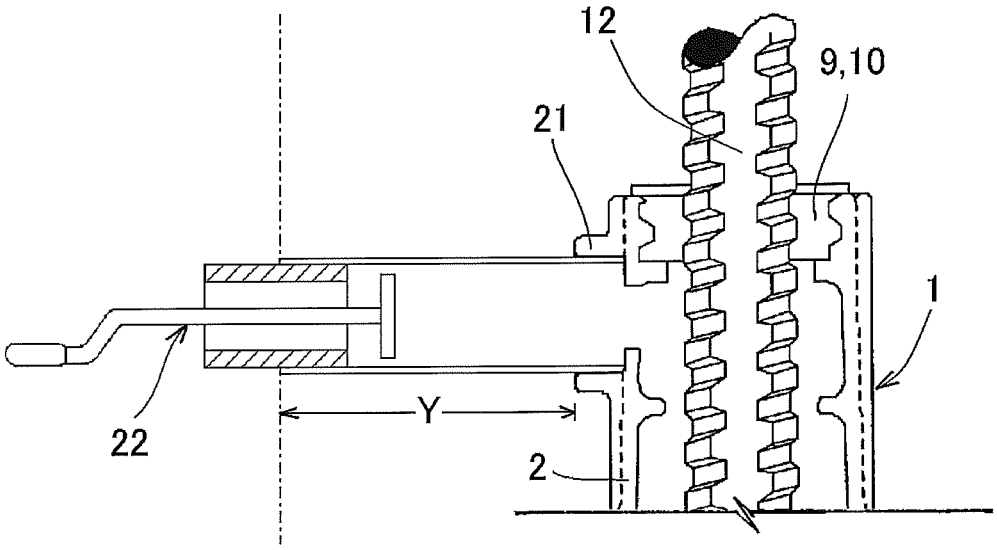
FIG. 4C is a cross-sectional view of another example showing a state where the sealing plug is fitted in the grout outlet through an extension pipe.

FIG. 4C shows an example for allowing securement of predetermined concrete cover thickness dimension Y from a position of the reinforcement joint 1 to an outer end surface of a finished member such as a column or a beam by, for example, locating the reinforcement joint 1 on the depth side of the finished member. In FIG. 4C, an extension pipe such as a vinyl chloride pipe is inserted into and fixed to the protruding opening 21, which becomes the grout outlet 8, and fitted with the sealing plug 22. The extension pipe is employed and constructed so as to be integral with the long sealing body 16*a* or 16*b* or the like fitted in and fixed to the grout inlet 7 side shown in FIGS. 3C and 3D.

Figure 4D:
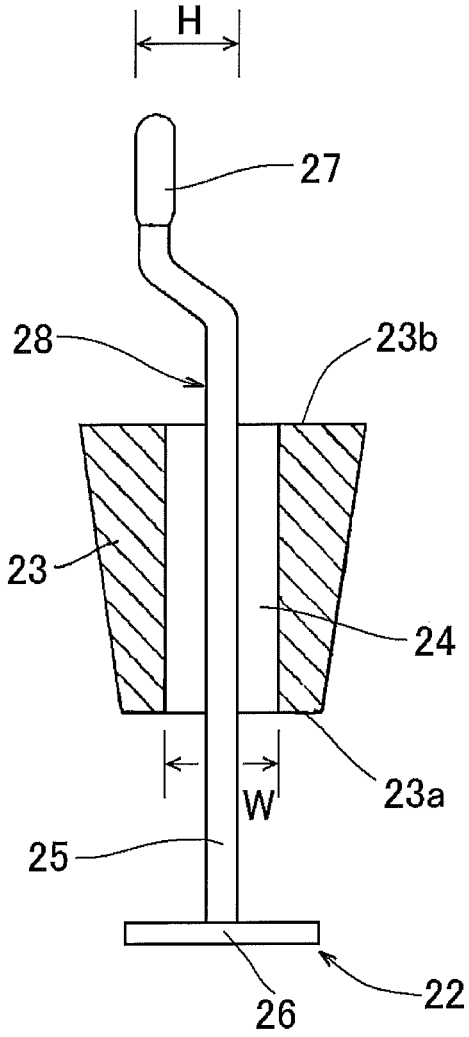
FIGS. 4D and 4E are cross-sectional views showing aspects of the sealing plug.

As shown in FIG. 4D, the sealing plug 22 is constituted of a plug body 23 fitted in the protruding opening 21, a through hole 24 provided at the center of the plug body 23, a shaft body 25 freely sliding to the left and right sides and the inside and outside in a state of being loosely inserted in the through hole 24, and a piston body 28 constituted of a pressure receiver 26 provided at one end of the shaft body 25 so as to be located in the inside space of the reinforcement joint 1 and a retainer 27 which is the other end of the shaft body 25 and is located outside of the reinforcement joint 1.

The plug body 23 is formed of a material such as rubber and flexible hard synthetic resin and has a shape having a frustoconical cross-section. In the plug body 23, an inner end surface on the pressure receiver 26 side is a small-diameter end surface 23*a*, an outer end surface is a large-diameter end surface 23*b*, and a tapered inclined surface is provided between the end surfaces. The plug body 23 is formed of such a material and has such a shape that the plug body 23 is easily fitted with the protruding opening 21 and less likely to fall off from the protruding opening 21.

The shaft body 25 of the piston body 28 is a long bar-like member formed of rubber, synthetic resin, or other material, and as in the plug body 23, the material is not limited especially. The shaft body 25 is loosely inserted into the through hole 24 of the plug body 23 and freely slides to the left and right sides and the inside and outside, and the plate-shaped pressure receiver 26 at one end located in the inside space of the reinforcement joint 1 has a shape receiving the pressure of the grout being filled in the inside space of the reinforcement joint 1, whereby the shaft body 25 in the through hole 24 can be moved outward.

The retainer 27 is provided at the other end of the shaft body 25 and, in this example, has a folded shape obtained by folding the shaft body 25 in a stepped shape. As the folded shape, in the direction perpendicular to the shaft body 25, a width H from one side edge of the shaft body 25 to the folded other side edge is substantially the same as or slightly larger than a hole diameter W of the through hole 24 of the plug body 23. Consequently, when the opposite side wall sides of the plug body 23 are pressed, the hole diameter W on the side perpendicular to the side walls can be slightly increased, and the retainer 27 is inserted into and passed through the plug body 23 from the small-diameter end surface 23*a* side and can be disposed in the through hole 24. A string or the like is tied to the folded retainer 27 having the folded shape to be pulled, and, thus, to allow simplified passing of the retainer 27 through the through hole 24. According to this constitution, the shaft body 25 of the piston body 28 is in a loosely inserted state in the through hole 24 of the plug body 23 and is integral with the plug body 23.

As a relationship between the shaft body 25 and the pressure receiver 26, there are considered various aspects such as an aspect that the shaft body 25 and the pressure receiver 26 are formed by adhering or fusion-connecting an integrally formed object or separately provided objects, an aspect that a concavoconvex portion is formed at an end of the shaft body 25, and the pressure receiver 26 is removably fitted in the concavoconvex portion, and an aspect that a bulge portion such as a folded back portion is provided at the end of the shaft body 25, and the pressure receiver 26 is fitted in the bulge portion. According to these constitutions, the shaft body 25 is easily inserted into and removed from the through hole 24 of the plug body 23, and removal of the grout solidified in the through hole 24 and cleaning after the removal are simplified.

On the other hand, although the shaft body 25 once inserted does not fall off from the through hole 24, especially when the shaft body 25 has a material and a shape causing friction over the whole circumference of the inner wall of the through hole 24, the shaft body 25 can be strongly prevented from being disconnected from the through hole 24 unless a special load is applied to the inside of the through hole 24 upon transportation and in an unused state.

Figure 4E:
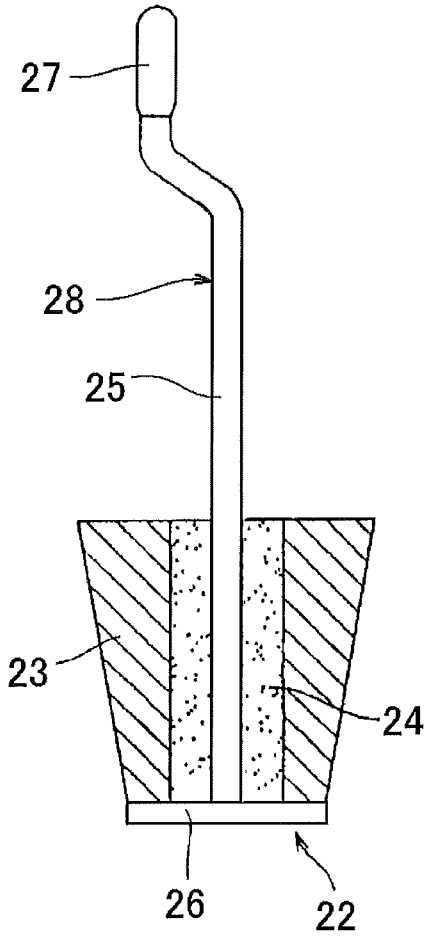

On the other hand, after the use of the sealing plug 22, although the pressure receiver 26 is pushed by the grout being filled in the inside space of the reinforcement joint 1 as shown in FIG. 4E, the previously flowing pasty grout is filled in the through hole 24.

Thereafter, the pressure receiver 26 is forcibly pressed toward the small-diameter end surface 23*a* of the plug body 23 to close the protruding opening 21. Although the grout is solidified in that state, the plug body 23, the shaft body 25, the pressure receiver 26, and so on enter a fixed state.

After the solidification of the grout, the sealing plug 22 in the solidified state can be easily removed by being moved frontwardly and rearwardly, and left and right relative to the protruding opening 21. After the removal, the grout solidified in the through hole 24 is removed, so that the shaft body 25 of the piston body 28 is in a loosely inserted state in the through hole 24. As a means thereof, since the retainer 27 has a size which is easily gripped, the retainer 27 is gripped, and while the inside of the through hole 24 is visualized, the shaft body 25 is, for example, moved frontwardly and rearwardly, and left and right or rotated to cause cracks and breakage of the solidified grout. Then, the solidification states of the plug body 23, the shaft body 25, and the pressure receiver 26 due to the grout are released, and the grout in the through hole 24 can be removed.

Moreover, the plug body 23 is, for example, deformed to remove the retainer 27 from the through hole 24, and the plug body 23 and the piston body 28 can be separated. Consequently, the grout stuck to the inner wall of the through hole 24 and the grout attached to the shaft body 25 and the pressure receiver 26 can be completely cleaned and removed, and the piston body 28 is mounted in the plug body 23 again to allow the sealing plug 22 to be reutilized.

In FIGS. 1 to 4 in the example 1, although the reinforcement joint 1 is a horizontal reinforcement joint, it is obvious that the reinforcement joint 1 can be used in not only construction for completing a horizontal member such as a beam but also in construction for completing a vertical member such as a column.

Example 2

Figure 5:
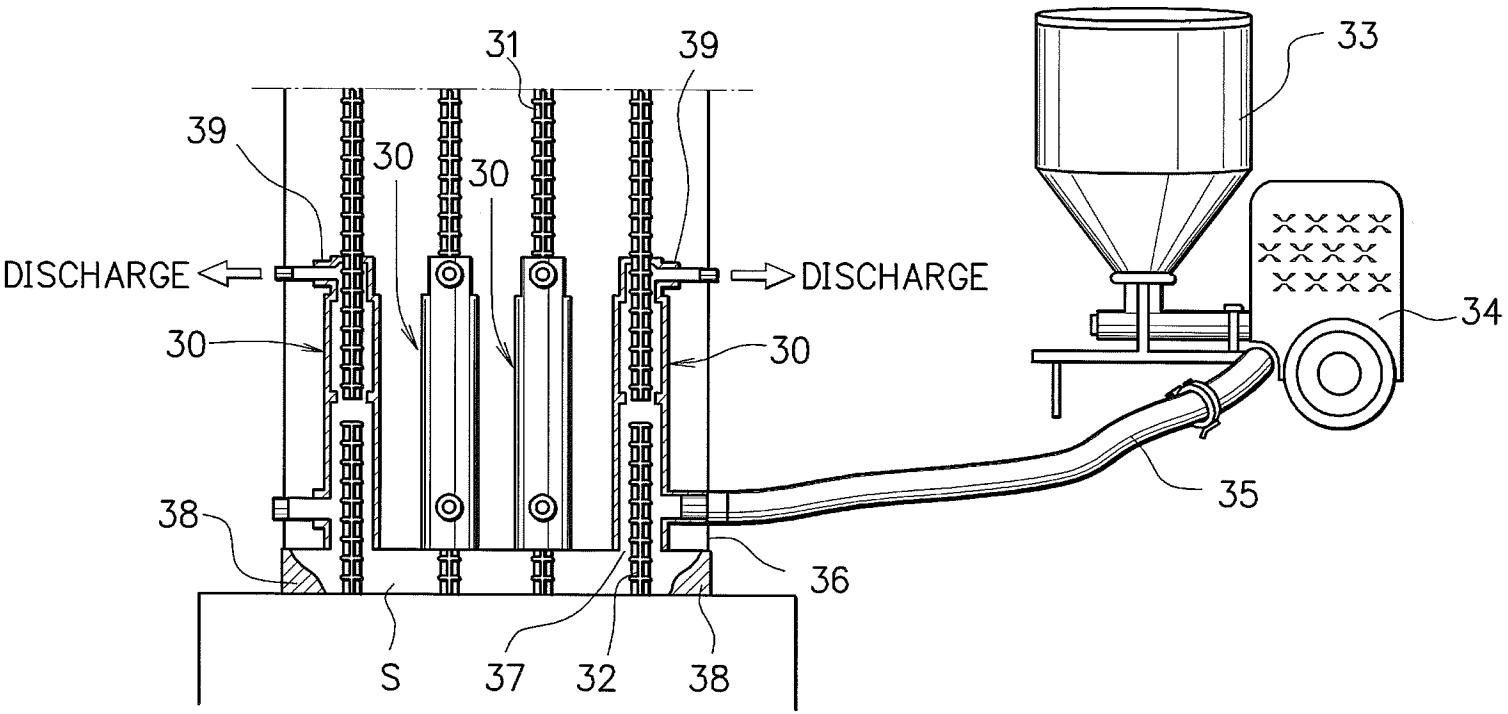
FIG. 5 is a cross-sectional view of an example of the joint method for a reinforcing bar that uses the reinforcement joint in a precast concrete member and shows a connection between a structure and the precast concrete member.

FIG. 5 shows an example in which a grout-filled reinforcement joint 30 is used in an end of a vertical member such as a column, which becomes a precast concrete member. An end of a reinforcing bar 31 extending to a position of a lower portion of the precast concrete member is previously inserted into one opening of the reinforcement joint 30 and fixed in a factory or the like, and the other opening of the reinforcement joint 30 is in a state of being exposed at a lower end of the precast concrete member. In a construction field, the precast concrete member is descended to the exposed opening of the reinforcement joint 30 while a reinforcing bar 32 provided upright from a column or the like of a structure, whereby a joining portion between the precast concrete member and the structure is subjected to construction.

The reinforcing bar 32 provided upright from the structure is stored in the reinforcement joint 30 and located facing the reinforcing bar 31 in the precast concrete member. In this state, the grout stored in a container 33 is filled in an inside space of the reinforcement joint 30 from an injection nozzle on a front end side of a tube body 35 or a grout inlet 36 directly connected to the tube body 35 through the tube body 35 by pressure of a grout injection pump 34.

Although the filled grout is filled in the inside space of the reinforcement joint 30, in this example a sealing member is not provided between the reinforcing bar 32 provided upright from the lower structure and a lower opening 37 of the reinforcement joint 30, whereby the grout is filled in a gap S generated between the structure and a column constituted of the precast concrete member. When the periphery of the gap S is enclosed by a frame member 38, the grout is not leaked outside through the gap S, so that the grout is filled.

By continuing the injection of the grout, the grout is filled in the gap S and, at the same time, filled in the inside spaces of the reinforcement joints 30 located at other positions and communicating through the gap S. At this time, the grout inlets 36 of the reinforcement joints 30 at other positions are sealed to prevent the grout from flowing outside. The grout moves up to the inside spaces in the reinforcement joints 30, and a pasty grout first enters into the through hole 24 of the sealing plug 22 fitted in a grout outlet 39. Thereafter, the pressure receiver 26 protruding inside the inside space is pushed toward the plug body 23 by the grout, so that the retainer 27 provided at an outer end of the shaft body 25 is protruded outward.

The inside space of the reinforcement joint 30 at a position in proximity to the injection nozzle, which is a grout injection side, or the tube body 35 is first filled with the grout, and the retainer 27 protrudes outside. Then, the retainers 27 of the reinforcement joints 30 at other positions protrude outward in sequence. Since the pressure receiver 26 is located at an upper end of the reinforcement joint 30, when the pressure receiver 26 is pressed, the grout reaches the upper end of the reinforcement joint 30. Accordingly, when the retainer 27 protrudes outward, termination of the filling can be confirmed.

When the above filling operation is terminated, even if the injection nozzle or the tube body 35 is removed, the grout does not flow outside from the grout inlet 36 because the grout inlet 36 is provided with the check valve 17, and the container 33 for storing the grout, the pump 34, the tube body 35, and so on can be used in the next reinforcement joint 30 or the grout injection operation for the next portion.

Although a grout outlet 39 is fitted with the sealing plug 22, the sealing plug 22 is removed once the grout filled in the inside space of the reinforcement joint 30 is solidified, and the solidified pasty grout entering inside the through hole 24 is removed, whereby the sealing plug 22 can be utilized.

What is claimed is:

1. A joint method for a reinforcing bar comprising the steps of:

providing an elongated reinforcement joint which is surrounded by a side wall, the side wall being formed as a cylindrical body with openings at opposite ends thereof, the side wall having a grout inlet provided at one of the ends and an outlet provided at the other of the ends;

when the grout inlet is a protruding opening protruding outward, fitting the protruding opening with a cylindrical sealing body constituted of an elastic body including a check valve provided at one end of the sealing body;

when the grout outlet is a protruding opening protruding outward, fitting a sealing plug in the protruding opening directly or through an extending pipe, the sealing plug including a plug body constituted of an elastic body having a through hole at the center, a shaft body movably inserted into the through hole, and a piston body including a pressure receiver protruding from the plug body and located adjacent the reinforcement joint and a retaining end protruding from the plug body and spaced from the reinforcement joint;

inserting reinforcing bars into an inside space of the cylindrical body from both ends thereof until the reinforcing bars reach an abutment position or a proximal position;

forcibly pressing the shaft body in the through hole of the sealing plug from outside to inside and positioning the shaft body so that the pressure receiver located at a front end of the shaft body protrudes towards the cylindrical body and so that the inside space of the cylindrical body and the through hole communicate with each other;

mounting a grout insertion end of a tube body connected to a grout supply to the sealing body fitted in the grout inlet and injecting grout into the inside space of the cylindrical body, or into a gap located between the inside space and a member or a structure and communicating with the inside space, by pump pressure;

flowing paste components of the grout in the through hole through a communicating portion located between the pressure receiver protruding toward the cylindrical body and the inside space of the cylindrical body and filling the inside of the through hole; and stopping the injection of the grout once the pressure receiver is pushed outward by pressure of the grout located in the inside space of the cylindrical body and the retaining end of the shaft body protrudingly moves outward to a predetermined position.

2. A joint method for a reinforcing bar comprising the steps of:

providing an elongated reinforcement joint which is surrounded by a side wall, the side wall being formed as a cylindrical body with openings at opposite ends thereof, the side wall having a grout inlet provided at one of the ends and an outlet provided at the other of the ends;

providing a sealing member with a reinforcing bar insertion hole at one or both openings of the cylindrical body and blocking a gap generated between the inserted reinforcing bar and an edge portion of the respective opening;

when the grout inlet is a protruding opening protruding outward, fitting a cylindrical sealing body constituted of an elastic body including a check valve provided at one end of the sealing body;

when the grout outlet is a protruding opening protruding outward, fitting a sealing plug in the protruding opening directly or through an extending pipe, the sealing plug including a plug body constituted of an elastic body having a through hole at the center, a shaft body movably inserted into the through hole, and a piston body including a pressure receiver protruding from the plug body and located adjacent the reinforcement joint and a retaining end protruding from the plug body and spaced from the reinforcement joint;

inserting reinforcing bars into an inside space of the cylindrical body from both ends thereof until the reinforcing bars reach an abutment position or a proximal position;

forcibly pressing the shaft body in the through hole of the sealing plug from outside to inside and positioning the shaft body so that the pressure receiver located at a front end of the shaft body protrudes to towards the cylindrical body and the inside space of the cylindrical body and the through hole communicate with each other;

mounting a grout insertion end of a tube body connected to a grout supply to the sealing body fitted in the grout inlet and injecting grout into the inside space of the cylindrical body, or into a gap located between the inside space and a member or a structure and communicating with the inside space, by pump pressure;

flowing paste components of the grout in the through hole through a communicating portion located between the pressure receiver protruding toward the cylindrical body and the inside space of the cylindrical body and filling the inside of the through hole; and stopping the injection of the grout once the pressure receiver is pushed outward by pressure of the grout located in the inside space of the cylindrical body and the retaining end of the shaft body protrudingly moves outward to a predetermined position.

3. A joint method for a reinforcing bar comprising the steps of:

providing an elongated reinforcement joint which is surrounded by a side wall, the side wall being formed as a cylindrical body with openings at opposite ends thereof, the side wall having a grout inlet provided at one of the ends and an outlet provided at the other of the ends;

when the grout inlet is a protruding opening protruding outward, fitting the protruding opening with a cylindrical sealing body constituted of an elastic body including a check valve provided at one end of the sealing body;

when the grout outlet is a protruding opening protruding outward, fitting a sealing plug in the protruding opening directly or through an extending pipe, the sealing plug including a plug body constituted of an elastic body having a through hole at the center, a shaft body movably inserted into the through hole, and a piston body including a pressure receiver protruding from the plug body and located adjacent the reinforcement joint and a retaining end protruding from the plug body and spaced from the reinforcement joint;

providing a sealing member with a reinforcing bar insertion hole at one or both openings of the cylindrical body and blocking a gap generated between the inserted reinforcing bar and an edge portion of the respective opening;

inserting reinforcing bars into an inside space of the cylindrical body from both ends thereof until the reinforcing bars reach an abutment position or a proximal position;

forcibly pressing the shaft body in the through hole of the sealing plug from outside to inside and positioning the shaft body so that the pressure receiver located at a front end of the shaft body protrudes towards the cylindrical body and the inside space of the cylindrical body and the through hole communicate with each other;

mounting a grout insertion end of a tube body connected to a grout supply to the sealing body fitted in the grout inlet and injecting grout into the inside space of the cylindrical body, or into a gap located between the inside space and a member or a structure and communicating with the inside space, by pump pressure;

flowing paste components of the grout in the through hole through a communicating portion located between the pressure receiver protruding toward the cylindrical body and the inside space of the cylindrical body and filling the inside of the through hole; and stopping the injection of the grout once the pressure receiver is pushed outward by pressure of the grout located in the inside space of the cylindrical body and the retaining end of the shaft body protrudingly moves outward to a predetermined position.

4. The joint method for a reinforcing bar according to claim 1, wherein in a final step of stopping the injection of the grout once the pressure receiver protruding toward the cylindrical body of the plug body fitted in the protruding opening of the grout outlet directly or through the extension pipe is pushed outward by the pressure of the grout located in the inside space of the cylindrical body and the retaining end of the shaft body protrudingly moves outward to the predetermined position, the grout enters into a plurality of reinforcement joints at other positions through a gap which communicates with the inside space of the reinforcement joints at the other positions, and the injection of the grout is stopped once the retaining ends of all the shaft bodies of the plurality of reinforcement joints protrudingly move outward to the predetermined position.

5. The joint method for a reinforcing bar according to claim 1, wherein the sealing body is an elongated member extending in a longitudinal direction.

6. The joint method for a reinforcing bar according to claim 1, wherein the check valve of the sealing body is provided adjacent the cylindrical body.

7. The joint method for a reinforcing bar according to claim 1, wherein the check valve of the sealing body is provided adjacent the cylindrical body and grout is supplied to the cylindrical body through the check valve.

8. The joint method for a reinforcing bar according to claim 1, wherein the pressure receiver of the plug body is removable from the shaft body.

9. The joint method for a reinforcing bar according to claim 1, wherein the plug body of the sealing plug is formed with a tapered side surface, the plug body having a small-diameter end surface adjacent the pressure receiver and a large-diameter end surface spaced from the small-diameter end surface.

10. The joint method for a reinforcing bar according to claim 1, wherein the grout insertion end of the tube body is a nozzle.

11. The joint method for a reinforcing bar according to claim 1, wherein the grout insertion end of the tube body is mounted to an outer end of the sealing body.

12. The joint method for a reinforcing bar according to claim 2, wherein in a final step of stopping the injection of the grout once the pressure receiver protruding toward the cylindrical body of the plug body fitted in the protruding opening of the grout outlet directly or through the extension pipe is pushed outward by the pressure of the grout located in the inside space of the cylindrical body and the retaining end of the shaft body protrudingly moves outward to the predetermined position, the grout enters into a plurality of reinforcement joints at other positions through a gap which communicates with the inside space of the reinforcement joints at the other positions, and the injection of the grout is stopped once the retaining ends of all the shaft bodies of the plurality of reinforcement joints protrudingly move outward to the predetermined position.

13. The joint method for a reinforcing bar according to claim 2, wherein the sealing body is an elongated member extending in a longitudinal direction.

14. The joint method for a reinforcing bar according to claim 2, wherein the check valve of the sealing body is provided adjacent the cylindrical body.

15. The joint method for a reinforcing bar according to claim 2, wherein the check valve of the sealing body is provided adjacent the cylindrical body and grout is supplied to the cylindrical body through the check valve.

16. The joint method for a reinforcing bar according to claim 2, wherein the pressure receiver of the plug body is removable from the shaft body.

17. The joint method for a reinforcing bar according to claim 2, wherein the plug body of the sealing plug is formed with a tapered side surface, the plug body having a small-diameter end surface adjacent the pressure receiver and a large-diameter end surface spaced from the small-diameter end surface.

18. The joint method for a reinforcing bar according to claim 2, wherein the grout insertion end of the tube body is a nozzle.

19. The joint method for a reinforcing bar according to claim 2, wherein the grout insertion end of the tube body is mounted to an outer end of the sealing body.

20. The joint method for a reinforcing bar according to claim 3, wherein in a final step of stopping the injection of the grout once the pressure receiver protruding toward the cylindrical body of the plug body fitted in the protruding opening of the grout outlet directly or through the extension pipe is pushed outward by the pressure of the grout located in the inside space of the cylindrical body and the retaining end of the shaft body protrudingly moves outward to the predetermined position, the grout enters into a plurality of reinforcement joints at other positions through a gap which communicates with the inside space of the reinforcement joints at the other positions, and the injection of the grout is stopped once the retaining ends of all the shaft bodies of the plurality of reinforcement joints protrudingly move outward to the predetermined position.

21. The joint method for a reinforcing bar according to claim 3, wherein the sealing body is an elongated member extending in a longitudinal direction.

22. The joint method for a reinforcing bar according to claim 3, wherein the check valve of the sealing body is provided adjacent the cylindrical body.

23. The joint method for a reinforcing bar according to claim 3, wherein the check valve of the sealing body is provided adjacent the cylindrical body and grout is supplied to the cylindrical body through the check valve.

24. The joint method for a reinforcing bar according to claim 3, wherein the pressure receiver of the plug body is removable from the shaft body.

25. The joint method for a reinforcing bar according to claim 3, wherein the plug body of the sealing plug is formed with a tapered side surface, the plug body having a small-diameter end surface adjacent the pressure receiver and a large-diameter end surface spaced from the small-diameter end surface.

26. The joint method for a reinforcing bar according to claim 3, wherein the grout insertion end of the tube body is a nozzle.

27. The joint method for a reinforcing bar according to claim 3, wherein the grout insertion end of the tube body is mounted to an outer end of the sealing body.

* * * * *